US005853047A

United States Patent [19]

Kim

[11] Patent Number: 5,853,047

[45] Date of Patent: Dec. 29, 1998

[54] HEAT EXCHANGER FOR AIR CONDITIONER

[75] Inventor: Young-Saeng Kim, Inchun, DPR of Korea

[73] Assignee: Samsung Electronics Co., Ltd., Suwon, Rep. of Korea

[21] Appl. No.: 912,988

[22] Filed: Aug. 12, 1997

[30] Foreign Application Priority Data

Oct. 31, 1996 [KP] DPR of Korea ..... 96-50686

[51] Int. Cl.[6] ..... F28D 1/04; F28F 1/32

[52] U.S. Cl. ..... 165/151; 165/906; 165/DIG. 503

[58] Field of Search ..... 165/151, 182, 165/906

[56] References Cited

U.S. PATENT DOCUMENTS

| | | | |
|---|---|---|---|
| 5,111,876 | 5/1992 | Nash | 165/151 |
| 5,685,367 | 11/1997 | Jun | 165/151 |
| 5,706,885 | 1/1998 | Kim | 165/151 |

FOREIGN PATENT DOCUMENTS

| | | | |
|---|---|---|---|
| 60-194293 | 10/1985 | Japan | 165/151 |
| 2-309195 | 12/1990 | Japan | 165/151 |
| 635188 | 4/1950 | United Kingdom | 165/151 |
| 861941 | 3/1961 | United Kingdom | 165/151 |

*Primary Examiner*—Allen Flanigan
*Attorney, Agent, or Firm*—Burns, Doane, Swecker & Mathis, L.L.P.

[57] ABSTRACT

A heat exchanger for an air conditioner having a plurality of parallel heat exchanging tubes passing through flat fins perpendicular thereto, the flat fins being arranged in parallel to each other at predetermined intervals, and each heat exchanging tube having fluids flowing inside therethrough, the heat exchanger comprising a plurality of louvers radially arranged around the tube, each louver being opened in flow direction of the air currents, such that the air currents flowing into the front and rear surfaces is turbulent around the tube, and first and second beads formed, respectively, before and behind the heat exchanging tubes in flow direction of the air currents, thereby enlarging a whole surface area of the flat fins, and reinforcing the flat fins, by which there is provided the turbulence and mixture of the air currents, further improving the heat transfer effect and reducing the air dead region around the heat exchanging tube. Also, the continuity of the heat transfer from the tube into other places can be guaranteed, with the improved heat transfer. Moreover, the beads provide the enlargement of the surface area of the flat fin and improved reinforcing thereof.

2 Claims, 3 Drawing Sheets

HEAT EXCHANGER FOR AIR CONDITIONER

BACKGROUND OF THE INVENTION

1. Field of the Invention

The invention relates to a heat exchanger for an air conditioner, and more particularly to the heat exchanger having a plurality of louver patterns around heat exchanging tubes perpendicularly passing through flat fins by which the air currents flowing therethrough become turbulent and mixed to advantageously effect the heat transfer performance, and further an air dead region around each tube is reduced.

2. Description of the Prior Art

A conventional heat exchanger for an air conditioner includes, as shown in FIG. 1, a plurality of flat fins 1 arranged in a parallel relation to each other at predetermined intervals and a plurality of heat exchanging tubes 2 passing through the fins 1 perpendicular thereto. The air currents flow in the space defined between the fins 1 in the direction of the arrow in FIG. 1 and exchanges heat with the fluid flowing in the heat exchanging tubes 2.

For a thermal fluid flowing around each flat fin 1, there has been known that the thickness of the thermal boundary layer 3 on both heat transfer surfaces of the fin 1 is gradually thickened in proportion to square root of the distance from the air current inlet end of the fin 1 as shown in FIG. 2. In this regard, the heat transfer rate of the fin 1 is remarkably reduced in proportion to the distance from the air current inlet end. Therefore, the above heat exchanger has a lower heat transfer efficiency.

For the thermal fluid flowing about each heat exchanging tube 2, there has been also known that, when lower velocity air currents flow in the direction of the arrow of FIG. 3, the air currents are separated from the outer surface of the tube 2 at portions spaced apart from the center point of outer surface of the tube 2 at angles of 70-degrees to 80-degrees. Therefore, an air dead region 4 is formed behind each tube 2 in a direction of the air flow as shown in the hatched region of FIG. 3. In the air dead region 4, the heat transfer rate of the tube 2 is remarkably reduced so that the heat transfer efficiency of the above heat exchanger becomes worse.

In order to overcome the above problems, there has been proposed another solution as disclosed in Japanese utility model laid-open publication No. sho 55-110995. As illustrated in FIG. 4, this heat exchanger includes a plurality of heat exchanging tubes 2 which are fitted into the regularly spaced flat fins 1 such that the tubes 2 are perpendicular to the fins 1. The heat exchanger also includes a plurality of rectangular louver patterns which are formed adjacent the tubes 2 passing through each fin 1. Each louver 5*a*, 5*b*, 5*c*, 5*d*, or 5*e* is formed by bending at a given angle the louver's outer edges relative to the plane of the flat fin 1, respectively, by way of the cutting process. Also, the louvers are vertically positioned to the heat exchanging tubes 2.

The above-described heat exchangers may provide the turbulence of the heat exchanging fluid, with operations of the employed louvers 5*a*, 5*b*, 5*c*, 5*d* and 5*e*. This operation advantageously reduces the thickness of the thermal boundary layers formed on the fins 1.

However, compared with higher heat transfer effect at louvers 5*a*, 5*b* placed upstream of the pattern, the remaining louvers 5*c*–5*f* placed downstream of the pattern exhibit lower heat transfer effect, because the louvers 5*c*–5*f* are in a range of the thermal boundary layers formed with respect to louvers 5*a* , 5*b*. Further, since upper and lower ends of the pattern of the louvers are parallel to the outer circumferential surface of the tube 2 and the patterns of the louvers are generally rectangular, an air dead region still exist behind each tube 2 in a direction of the air flow. Also, there is problem in that the air currents which are not mixed flow in the spaces between the plurality of flat fins 1, and the expected improvement of the heat transfer effect cannot be thus guaranteed which is caused by the mixture of the air currents.

SUMMARY OF THE INVENTION

Therefore, it is an object of the present invention to provide a heat exchanger which provides an improved heat transfer performance due to the turbulence and mixture of the air currents that flow in spaces between a plurality of flat fins, and also effectively reduces an air dead region found behind each tube in a direction of the air flow and thus improves the heat transfer performance.

Another object of the present invention is to provide the heat exchanger having bead portions for enlargement of a whole surface area of the flat fins, and an improved strength of the flat fins.

According the above objects of the present invention, there is provided a heat exchanger for an air conditioner having a plurality of parallel heat exchanging tubes passing through flat fins perpendicular thereto, the flat fins being arranged in parallel to each other at predetermined intervals, and each heat exchanging tube having fluids flowing inside therethrough, the heat exchanger comprising: a plurality of louvers radially arranged around the tube, each louver being opened in flow direction of the air currents, such that the air currents flowing into the front and rear surfaces is turbulent around the tube; and first and second beads formed, respectively, before and behind the heat exchanging tubes in flow direction of the air currents, thereby enlarging a whole surface area of the flat fins, and reinforcing the flat fins.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

The preferred embodiment according to the present invention will now be described in detail in accordance with the accompanying drawings. The same or corresponding elements or parts are designated with like references throughout the drawings.

Figure 1:
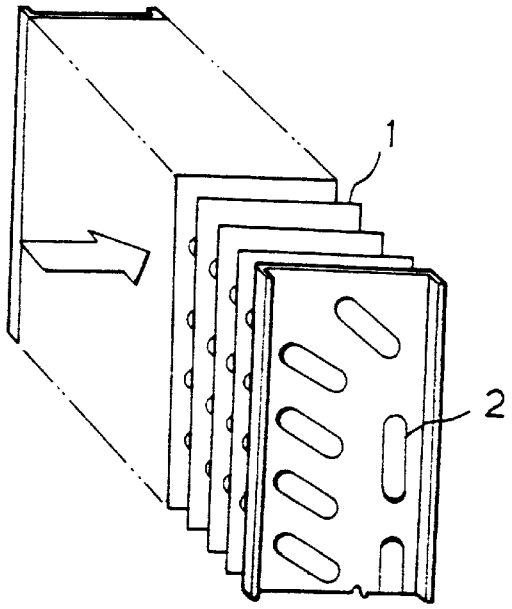
FIG. 1 (PRIOR ART)
FIG. 1 is a perspective view illustrating a conventional heat exchanger for an air conditioner.
Figure 2:
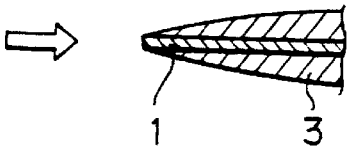
FIG. 2 (PRIOR ART)
FIG. 2 is an enlarged sectional view of a flat fin of the heat exchanger of FIG. 1, showing the characteristics of the thermal fluid flowing about the fin.
Figure 3:
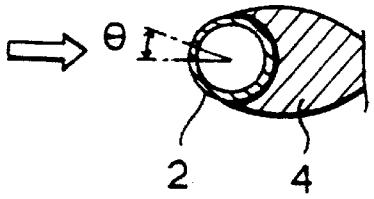
FIG. 3 (PRIOR ART)
FIG. 3 is an enlarged sectional view of a the heat exchanging tube of the heat exchanger of FIG. 1, showing the characteristics of the thermal fluid flowing about the heat exchanging tube.
Figure 4:
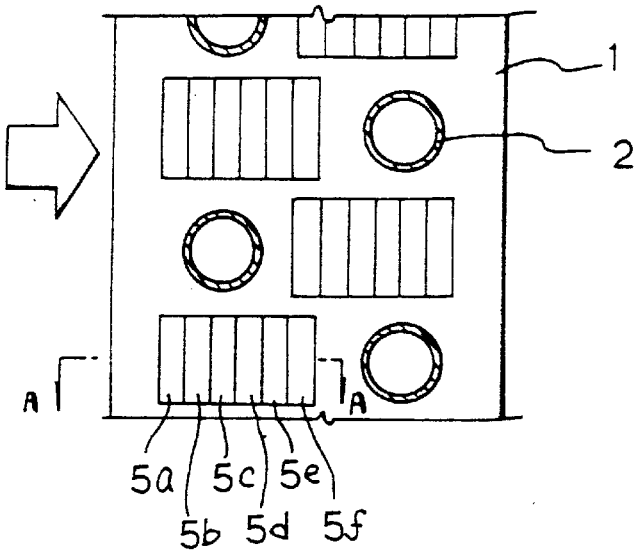
FIG. 4 (PRIOR ART)
FIG. 4 is a front view of a flat fin of another conventional heat exchanger.
Figure 5:
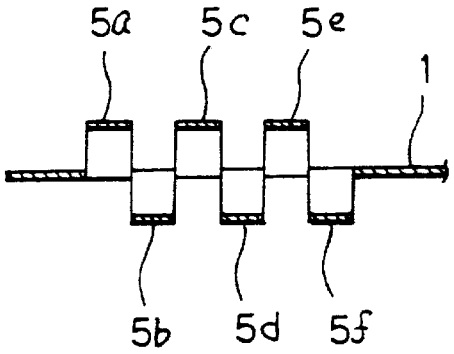
FIG. 5 (PRIOR ART)
FIG. 5 is a sectional view of the flat fin taken along line A—A in FIG. 4.
Figure 6:
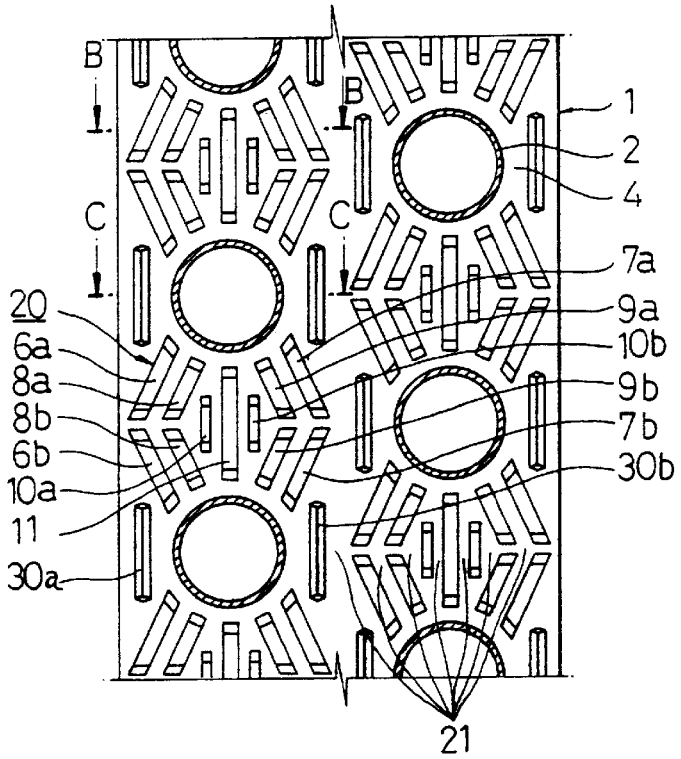
FIG. 6 is a front view of a flat fin in accordance with a heat exchanger of the present invention.

Referring to FIG. 6, reference numeral 20 generally denotes a group of angled louver patterns radially located around each tube 2, respectively. The louvers causes the air currents flow to be turbulent and to be mixed up, which effectively reduces an air dead region found behind each tube 2 in a direction of the air flow and thus improves the heat transfer performance. Improvement is accomplished by a group of the angled louver patterns located around the tube 2.

The pattern between tubes 2 comprise: first and second louvers 6*a*, 6*b* inclined opposite to each other, with a base portion 21 being interposed therebetween, such that the air currents passing between the tubes 2 are turbulent; third and fourth louvers 7*a*, 7*b* inclined opposite to each other, with a base portion 21 being interposed therebetween, also being symmetrical relative to the first and second louvers 6*a*, 6*b*, such that the air currents passing between the tubes 2 are turbulent; fifth and sixth louvers 8*a*, 8*b* inclined opposite to each other, with a base portion 21 being interposed between said louver 8*a*, 8*b* and 6*a*, 6*b*, such that the air currents passing between the tubes 2 are turbulent; seventh and eighth louvers 9*a*, 9*b* inclined opposite to each other, with a base portion 21 being interposed between said louvers 9*a*, 9*b* and 7*a*, 7*b*, such that the air currents passing between the tubes 2 are turbulent; vertical ninth and tenth louvers 10*a*, 10*b* opposite to each other, with a base portion 21 being interposed between the sixth and eighth louvers, such that the air currents passing a central portion between the tubes 2 are turbulent; and vertical eleventh louver 11, with a base portion 21 being interposed between the ninth and tenth louvers, such that the air currents passing a central portion between the tubes 2 are turbulent.

The first and second louvers 6*a*, 6*b* define upstream-most louvers of the plurality of louvers, and the third and fourth louvers 7*a*, 7*b* define downstream-most louvers of the plurality of louvers. The first and second louvers 6*a*, 6*b* (and also the fifth and sixth louvers 8*a*, 8*b*) converge toward one another in a direction opposite the direction of air flow, and the third and fourth louvers (and also the seventh and eighth louvers 9*a*, 9*b*) converge toward one another in the direction of air flow. Each of the louvers 6*a*, 7*a*, 8*a*, 9*a*, and 11 has a pair of parallel side edges SE extending generally radially with respect to an adjacent upper tube 2. Likewise, each of the louvers 6*b*, 7*b*, 8*b*, and 9*b* (and 11) has a pair of parallel side edges SE extending generally radially with respect to an adjacent lower tube 2.

It is noted that there is provided a common base portion 21 to each other, which occupies an area between the 1st, 3rd, 5th and 7th louvers and the 2nd, 4th, 6th, and 8th louvers. Further, the sectional areas of the 1st to 4th louvers 6*a*, 6*b*, 7*a*, 7*b* are, respectively, sized to be larger than that of the 5th to 8th louvers 8*a*, 8*b*, 9*a*, 9*b*.

Moreover, the 1st and 2nd louvers 6*a*, 6*b* has the same inclination as the 5th and 6th louvers 8*a*, 8*b*, and the 3rd and 4th louvers 7*a*, 7*b* also has the same inclination as the 7th and 8th louvers 9*a*, 9*b*, but the 3rd, 5th, 7th and 8th louvers being placed with inclination opposite to the 1st, 2nd, 5th and 6th louvers. The 1st, 3rd, 5th and 7th louvers 6*a*, 7*a*, 8*a*, 9*a* are placed with the same inclination as the 2nd, 4th, 6th and 8th louvers 6*b*, 7*b*, 8*b*, 9*b*, and symmetric thereto.

The 1st, 2nd, 3rd, 4th, 9th and 10th louvers 6*a*, 6*b*, 7*a*, 7*b*, 10*a*, 10*b* have a constant base portion 21 interposed therebetween, respectively. These louvers are protruded relative to the surface of the flat fin 1 by cutting process to be opened in flow direction of the air currents. The angled 5th, 6th, 7th, 8th, and 11th louvers 8*a*, 8*b*, 9*a*, 9*b* and 11, respectively, have a constant base portion 21 interposed between those louvers and the 1st, 2nd, 3rd, 4th, 9th and 10th louvers 6*a*, 6*b*, 7*a*, 7*b*,10*a*, 10*b*. These louvers 8*a*, 8*b*, 9*a*, 9*b*, 11 are protruded relative to a rear surface of the flat fin 1, by cutting process to be opened in flow direction of the air currents.

Figure 8:
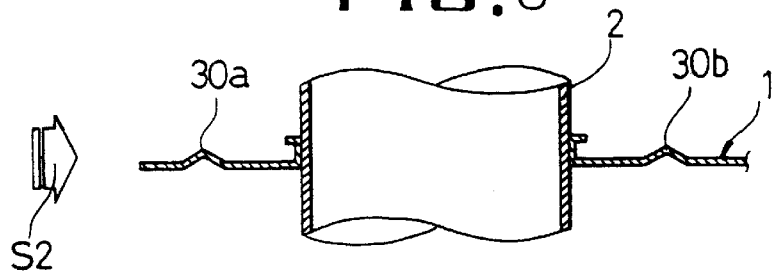
FIG. 8 is a sectional view of the flat fin taken along the section line C—C in FIG. 6.

Reference numerals 30*a*, 30*b* as shown in FIG. 8 denote a first bead and a second bead, which are positioned before and behind each tube 2 in a direction of the air flow as shown in the arrow in the drawing, respectively. The beads formed to be vertically bent by way of the beading process serve to reinforce the flat fin 1 and enlarge the surface area of the flat fin 1.

Namely, the first and second beads 30*a*, 30*b*, each being protruded toward rear side of the flat fin 1, are separated by the base portions 21 from each tube 2.

An operation and effect of the heat exchanger for the air conditioner will be described.

Figure 7:
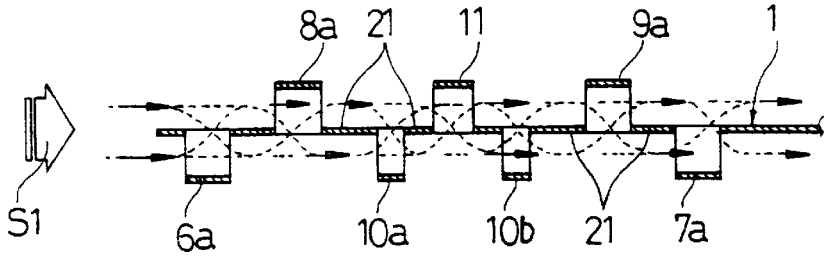
FIG. 7 is a sectional view of the flat fin taken along the section line B—B in FIG. 6.

When the air currents flow in the space defined between the fins 1 in the direction of the arrow S1 in FIG. 7, the air currents sequentially pass through the 1st to 11th louvers 6*a*, 6*b*, 7*a*, 7*b*, 8*a*, 8*b*, 9*a*, 9*b*, 10*a*, 10*b*, 11, and are turbulent. Then, the turbulent air currents are divided and flown into two separated paths in the directions of the dotted-lines as shown in FIG. 7 and mixed up, resulting in reduction of air dead region and improvement of heat transfer efficiency behind each tube 2 in a direction of the air flow as shown in the arrow S1 in the drawing. This is due to the fact that the louver pattern 20 has the 1st, 2nd, 3rd, 4th, 9th and 10th louvers 6*a*, 6*b*, 7*a*, 10*a*, 10*b* protruded along the front surface of the flat fin 1, with a constant base portion 21 interposed between those louvers and the 5th, 6th, 7th, 8th and 11th louvers 8*a*, 8*b*, 9*a*, 9*b*, 11 which are protruded along the rear surface of the flat fin 1, so that flow direction of the air currents does not belong to the thermal boundary layer formed by the 5th, 6th, 7th, 8th and 11th louvers 8*a*, 8*b*, 9*a*, 9*b*, 11.

Further, since the 1st, 2nd , 3rd, 4th, 5th, 6th, 7th, 8th and 11th louvers 6*a*, 6*b*, 7*a*, 7*b*, 8*a*, 8*b*, 9*a*, 9*b*, 11 are radially arranged with respect to the heat exchanging tube 2 with the base portion 21 interposed therebetween, turbulence of the flowing air currents can be accomplished, also the flowing air currents can be distributed around the tube 2, which allows reduction of the air dead region and increases in heat transfer efficiency behind each tube 2 in a direction of the air flow. Further, this operation allows the thermal flow from the heat exchanging tube 2 to be continuously transferred.

Still further, when the air currents flow in the direction of the arrow S2 in FIG. 8, the air currents contact the first and second bead portions 30*a*, 30*b*, thereby increasingly improving the heat transfer efficiency.

As described above, this invention is characterized in that a plurality of louvers are radially arranged about the tube, further each being alternatively formed at front and rear sides of the flat fin. This configuration provides the turbulence and mixture of the air currents, further improves the heat transfer effect and reduces the air dead region around the heat exchanging tube. Therefore, the continuity of the heat transfer from the tube into other places can be guaranteed, with the improved heat transfer. Moreover, the beads provide the enlargement of the surface area of the flat fin and improved reinforcing thereof.

What is claimed is:

1. A heat exchanger for an air conditioner having a plurality of parallel heat exchanging tubes passing through flat fins perpendicular thereto, the tubes including pairs of vertically spaced tubes, the flat fins being arranged in parallel to each other at predetermined intervals to enable air to flow between adjacent fins in a direction perpendicular to axes of the tubes, and each heat exchanging tube adapted to conduct fluid, the heat exchanger comprising:

a plurality of louvers formed in each fin between each pair of vertically spaced tubes, each plurality of louvers including:

a pair of first and second vertically spaced louvers defining upstream-most louvers of the plurality of louvers with reference to a direction of air flow, second and third vertically spaced louvers defining downstream-most louvers of the plurality of louvers with reference, fifth and sixth vertically spaced louvers disposed immediately downstream of the first and second louvers, seventh and eighth vertically spaced louvers disposed immediately upstream of the second and third louvers, ninth and tenth louvers extending vertically, the ninth louver disposed immediately downstream of the fifth and sixth louvers, the tenth louver disposed immediately upstream of the seventh and eighth louvers, and an eleventh louver extending vertically and situated between the ninth and tenth louvers, the eleventh louver being longer than either of the ninth and tenth louvers, and extending upwardly and downwardly past the ninth and tenth louvers, the first and second louvers converging toward one another in a direction opposite the direction of air flow, the third and fourth louvers converging toward one another in the direction of air flow, the fifth and sixth louvers converging toward one another in a direction opposite the direction of air flow, the seventh and eighth louvers converging toward one another in the direction of air flow, the first, second, third, fourth, ninth and tenth louvers projecting from a first side of the fin, the fifth, sixth, seventh, eighth, and eleventh louvers projecting from a second side of the fin disposed opposite the first side, each of the first, third, fifth, and seventh louvers having a pair of parallel side edges extending generally radially with respect to an upper one of the respective pair of tubes, each of the second, fourth, sixth and eighth louvers having a pair of parallel side edges extending generally radially with respect to a lower one of the respective pair of tubes; and first and second beads formed, respectively, upstream and downstream of each of the heat exchanging tubes, thereby enlarging an effective surface area of the flat fins, and reinforcing the flat fins.

2. The heat exchanger according to claim 1 wherein the first and second beads protrude from the second side of the fin.

* * * * *